United States Patent [19]

Sbrana

[11] Patent Number: 4,894,032

[45] Date of Patent: Jan. 16, 1990

[54] FLOATATION APPARATUS

[76] Inventor: Adolphe Sbrana, 11 Chemin de Font Sarrade, Martigues 13500, France

[21] Appl. No.: 295,000

[22] Filed: Jan. 9, 1989

Related U.S. Application Data

[63] Continuation of Ser. No. 122,532, Nov. 9, 1987, abandoned, which is a continuation of Ser. No. 923,496, Oct. 27, 1986, abandoned.

[30] Foreign Application Priority Data

Nov. 5, 1985 [FR] France ..... 85 16470

[51] Int. Cl.[4] ..... A63B 35/02

[52] U.S. Cl. ..... 440/13; 440/15; 114/357

[58] Field of Search ..... 440/13–15, 440/21; 441/67, 65; 114/66, 162, 165, 346, 347

[56] References Cited

U.S. PATENT DOCUMENTS

| | | | |
|---|---|---|---|
| 2,948,255 | 8/1960 | Sbrana | 440/21 |
| 3,710,408 | 1/1973 | Sorenson | 114/346 |
| 3,808,621 | 5/1974 | French | 114/66 |
| 4,172,427 | 10/1979 | Kindred | 115/28 R |
| 4,273,060 | 6/1981 | Pavincic | 114/39.1 |

FOREIGN PATENT DOCUMENTS

| | | | |
|---|---|---|---|
| 2127448 | 10/1072 | France . | |
| 1132732 | 11/1958 | France | 441/40 |
| 2497488 | 7/1982 | France . | |

OTHER PUBLICATIONS

Yachting Magazine, vol. 102. No. 5, Nov. 57, p. 6.

*Primary Examiner*—Joseph F. Peters, Jr.
*Assistant Examiner*—Ed Swinehart
*Attorney, Agent, or Firm*—Sandler & Greenblum

[57] ABSTRACT

A floatation apparatus including a buoyant body for supporting a passenger, which is preferably lens-shaped and made of transparent plastic material, and controls for the direction and propulsion of the floatation apparatus when in water including a rotatable shaft positioned within a vertical channel extending through the buoyant body having one end attached to a flexible flap and another end attached to a handle. The rotatable shaft is preferably located in a positioned eccentric with respect to the center of the buoyant body and is manipulated by the handle to move the flap in one direction or the other so as to propel the buoyant body and alter the course of the buoyant body in the water.

8 Claims, 1 Drawing Sheet

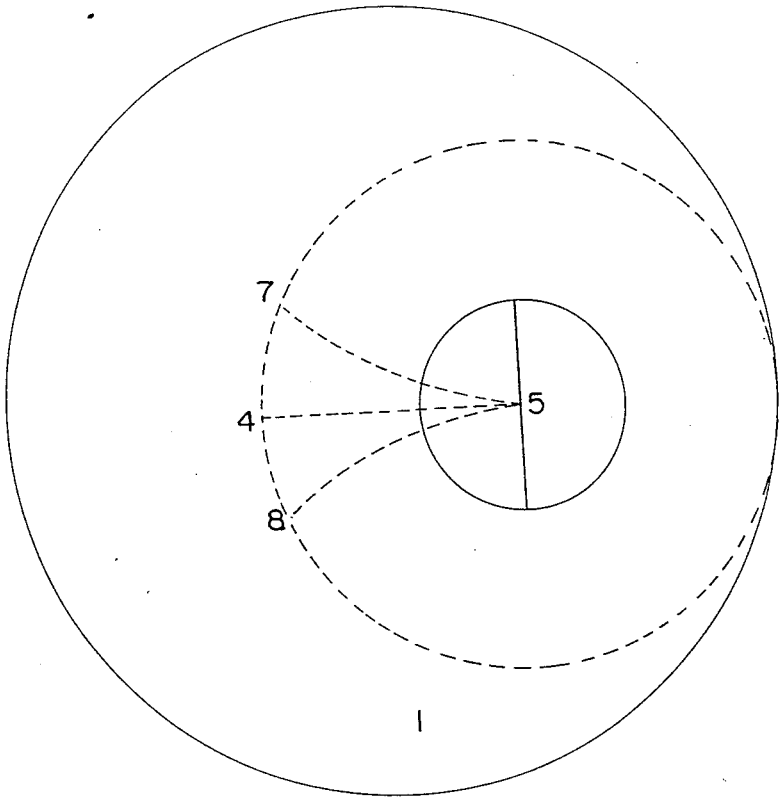
Fig. 1
Fig. 2
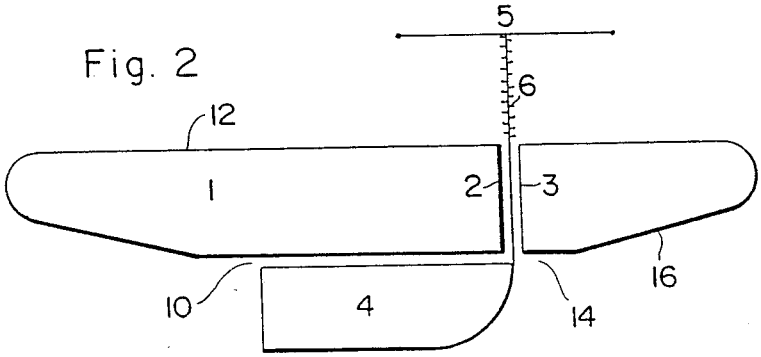

FLOATATION APPARATUS

This application is a continuation of application Ser. No. 122,532, filed Nov. 9, 1987, now abandoned, which is a continuation of application Ser. No. 923,496, filed Oct. 27, 1986, now abandoned.

BACKGROUND OF THE INVENTION

1. Field of the Invention

The present invention relates to floatation apparatus. In particular, the present invention is directed to floatation apparatus which is composed of a lens-shaped body of, preferably transparent, buoyant plastic material. More specifically, the present invention is directed to floatation apparatus including a buoyant support provided with a flap attached to the lower end of a rotatable shaft positioned eccentrically with respect to the center of the apparatus and extending below the submerged surface of the buoyant support for steering, as well as propelling, the floatation apparatus through water, preferably manually.

2. Discussion of Background and Material Information

Although floatation devices composed of a buoyant body having a generally circular configuration are known, such floatation devices are typically in the form of an inflatable tube or rubber raft. It is also conventional to equip a number of floatation devices, such as surf boards and wind-surfer boards, as well as sail boats, with rigid center-boards or keels beneath the floating surface of the craft to impart stability and direction to the craft. Sailboats are also equipped rudders for steering which can also be used to propel the boat by moving the tiller operably connected to the rudder using a back and forth movement. Conventional manually powered water craft include canoes, rowboats and the like wherein oars and paddles are used to manually propel and steer the craft. Another form of manually powered water craft is what is referred to as a paddle-boat. Typically paddle-boats are constructed from at least two pontoons connected by a seating platform and equipped with one or more pedal-and-chain drives connected to paddle wheels which propel the boat through the water.

Representative examples of floatation devices which bear some similarities to floatation apparatus of the present invention are disclosed in French Pat. No. 2,127,448, French Pat. No. 2,497,488, U.S. Pat. No. 3,808,621, and U.S. Pat. No. 4,172,427.

French Pat. No. 2,127,448 is a circular nautical device provided with an engine. The body of the nautical craft is composed of a lower section having a curved underside to be submerged in the water, and an upper section having walls raised above the water level to define a passenger compartment. The craft is equipped with a device including a rotatable shaft extending downwardly through the center of the craft having a handle attached to an upper end and a fin attached to a lower end submerged underwater adapted to be oscillated by rotation of the shaft.

French Pat. No. 2,497,488 is directed to a circular shaped raft-type of water craft having a raised seat and lower platform located forward of the seat in which a propulsion device is rotatably mounted. The propulsion device includes a motor having a handle operably connected to a drive shaft which extends downwardly through the platforms to power a propeller.

U.S. Pat. No. 3,808,621 is directed to a swimmer's viewing float having generally spherical facing upper and lower parts, the former having a concave viewing port and the latter being transparent. The upper and lower ports from a hollow compartment to accommodate a passenger.

U.S. Pat. No. 4,172,427 is directed to a propulsion unit for driving water craft. The water craft is in the form of a floating lounge chair and the propulsion unit is attached at the forward end of the seating platform to a frame connecting two floats. The propulsion unit includes a flexible fin attached to a drive member including a journal tube fixed to the frame in which a shaft having a handle at its upper end and attached to the fin at its lower end is rotatably mounted to permit oscillatory movement to be imparted to the fin.

The present invention is based on the novel and unique design of a floatation apparatus engineered to have a mechanism which makes it possible to easily maneuver the floatation apparatus in water, and is constructed of material, such as transparent plastic, so that it is particularly suitable for use by marine biologists, sportsmen, and others interested in observing underwater activity.

SUMMARY OF THE INVENTION

Accordingly, it is an object of the present invention to provide a floatation apparatus composed of a generally lens-shaped body, preferably having a plano-convex configuration, wherein the upper surface is substantially planar, which is preferably transparent and made from a polymer material, such as plastic, so as to function as a lens for underwater observation.

Another object of the present invention is to provide a floatation apparatus including a buoyant support body and means for controlling the direction of the floatation apparatus when in water operably associated with the body.

A further object of the present invention is to provide a floatation apparatus in accordance with the previously described embodiments which is equipped with means for controlling the position of the floatation apparatus, preferably in the form of a flap, which is flexible, attached to one end of a rotatable shaft, the other end which is provided with means for manipulating the shaft to alter the attitude of the flap.

A still further object of the present invention is to provide a floatation apparatus as described above wherein the buoyant support body is provided with a hollow channel having a longitudinal axis passing vertically through the body for accomodating the rotatable shaft, preferably wherein the longitudinal axis of the channel is eccentric with respect to a vertical axis extending through the center of the support body.

A yet still further object of the present invention is the provision of a floatation apparatus as described above wherein the means for manipulating the floatation device includes means for determining the direction of the buoyant body in water, and preferably includes means for propelling the body through water, preferably in the form of a handle.

BRIEF DESCRIPTION OF DRAWINGS

The attached drawings show, by way of non-limiting example, a preferred embodiment of the present invention.

FIG. 1 shows a top planar view of the apparatus of the present invention; and

FIG. 2 illustrates a vertical cross-section along a central longitudinal axis of the floatation apparatus of the present invention.

DESCRIPTION OF PREFERRED EMBODIMENTS

The floatation apparatus of the present invention includes a buoyant support body or floatation device 1 having a generally circular upper periphery which is preferably lens-shaped. As shown, the buoyant support body is generally plano-convex in shape having a lower surface 10 and an upper surface 12 intended to support a passenger. The lower surface 10 preferably is designed to having a generally planar lower central section 14, essentially parallel to upper surface 12 and a curved section 16 which slopes downwardly from the circular periphery towards the lower central section. The buoyant support body is preferably composed of transparent plastic material so as to render it suitable for underwater observation. Nevertheless, the body of the floatation apparatus may be made from essentially any material which is sufficiently buoyant to maintain the support body, in addition to passengers which use the apparatus, afloat. In addition to preferred buoyant materials such as polymeric substances, with plastics being most preferred, the body may be composed of cellulosic materials, such as wood, or elastomeric substances in the nature of foamed rubber and plastic or a hollow inflated rubber-tube structure.

The floatation apparatus of the present invention including a buoyant support body is provided with means for controlling the direction and position of the floatation apparatus operably associated with the support body. The means for controlling the direction of the floatation apparatus when in water operably associated with the support body includes a hollow channel 2 passing vertically through the support body for accomodating a rotatable shaft 3 having a lower end connected to a flap 4, which is preferably made of flexible material, and another end provided with means for manipulating the shaft, preferably in the form of a handle 5, or wheel.

It is preferred that the hollow channel be positioned so that its longitudinal axis is eccentric with respect to a vertical axis extending through the center of the buoyant support body. This arrangement permits the passenger to be seated at essentially the center of the upper surface of the floatation apparatus so that the weight of the passenger is uniformly distributed in a manner which permits the upper surface to remain essentially level thereby imparting stability to the floatation apparatus during use.

In addition, means for biasing, preferably in the nature of a spring 6, is positioned around the upper section of shaft 3 between handle 5 and the upper planar surface **1*b* of the buoyant body, so as to maintain the height of handle 5 at a desired level. The means for biasing also permits the user to press downwardly on the handle to displace flap 4 away from the lower surface of the buoyant body so that manipulation of handle 5 to change the direction or propel the body can be made without the flap 4** abrading against the lower surface of the buoyant body.

In operation, a passenger positions themselves on the upper planar surface of the buoyant body and manually manipulates handle 5 to rotate shaft 3 passing through hollow channel 2 to a desired degree to move flap 4 in one direction and/or another direction for the intended purposes of either altering the course of the buoyant body in the water, and/or imparting a reciprocal flapping or paddling motion to propel the buoyant body forward in the water.

As shown in FIG. 1, the flexible flap may be moved, for example, between positions shown as 7 and 8 in a reciprocal motion to propel the buoyant body in a forward direction, i.e., in a direction opposite the direction the passenger faces. Nevertheless, the particular arrangement of the rotatable shaft 3 and flap 4 is such that the flap 4 may be positioned radially at essentially any position with respect to shaft 3 so that its trailing end edge **4*a* would define a circle such as that shown by the dashed lines in FIG. 1 if the shaft 3 were rotated 360°. Regardless of the initial position of flap 4**, therefore, the flap may be moved to propel the buoyant body in essentially any direction as determined by the initial position of the flap by oscillating the flap essentially to the same degree on either side of the initial position of the flap. Naturally, if a turning motion is desired, this can be accomplished by moving the flap to a greater degree to one side of the initial position of the flap than the other, and the speed can be varied by controlling the alternating amplitude of the reciprocating motion of the flap.

Accordingly, the novel and unique arrangement of elements of the floatation apparatus of the present invention permits the floatation apparatus to be propelled in essentially any direction, as well as permitting the direction of the floatation apparatus to be changed completely around a full circle, in addition to providing a transparent buoyant support body as a mobile platform for underwater observation.

From the foregoing description, one skilled in the art can easily ascertain the essential characteristics of this invention and, without departing from the spirit and scope thereof, make various changes and modifications of the invention to adapt to various usages and conditions.

What is claimed is:

1. A flotation apparatus comprising:

(a) a buoyant body having an upper most planar surface with an essentially circular periphery for supporting a passenger and a lower surface including a flat bottom section and a sloping section extending upwardly at an oblique angle from said flat bottom towards said circular periphery; and (b) means for controlling the position of the flotation apparatus when in water operably associated with said body, said means for controlling consisting essentially of:

(i) a flap having a length sufficient to extend substantially across said flat bottom section;

(ii) a rotatable shaft having a longitudinal axis eccentric with respect to a vertical axis extending through the center of said body with an end attached directly to an end of said flap and another end provided with means for manipulating said shaft to alter the attitude of said flap 360° whereby said flap extends substantially across said flat bottom section at some time during a 360° attitude alteration of said flap; and (iii) a hollow channel for accommodating said shaft.

2. The floatation apparatus in accordance with claim 1, wherein said body is piano-convex in shape.

3. The floatation apparatus in accordance with claim 1, wherein said flap is flexible.

4. The floatation apparatus in accordance with claim 1, wherein said means for manipulating is a handle.

5. The floatation apparatus in accordance with claim 4, wherein a means for biasing is positioned around said shaft between said handle and said upper surface of the buoyant body.

6. The floatation apparatus in accordance with claim 1, wherein said body is made of a polymer material.

7. The floatation apparatus in accordance with claim 6, wherein said polymer material is a plastic material 8. A flotation apparatus comprising (a) a buoyant body of transparent plastic material having an upper most planar surface with an essentially circular periphery for supporting a passenger and a lower surface including a flat bottom section and a sloping section extending upwardly at an oblique angle from said flat bottom towards said circular periphery; and (b) means for controlling the position of the flotation apparatus when in water operably associated with said body, said means for controlling consisting essentially of:

(i) a flap having a length sufficient to extend substantially across said flat bottom section;

(ii) a rotatable shaft having a longitudinal axis eccentric with respect to a vertical axis extending through the center of said body with an end attached directly to an end of said flap and another end provided with means for manipulating said shaft to alter the attitude of said flap 360° whereby said flap extends substantially across said flat bottom section at some time during a 360° attitude alteration of said flap; and (iii) a hollow channel for accommodating said shaft.

* * * * *